US007380501B1

(12) United States Patent
Triviski et al.

(10) Patent No.: US 7,380,501 B1
(45) **Date of Patent: *Jun. 3, 2008**

(54) ELECTRO-THERMAL CHEMICAL IGNITER AND CONNECTOR

(75) Inventors: Michael R. Triviski, Oakdale, MN (US); David C. Cook, Eden Prairie, MN (US); Alan R. Sunnarborg, Robbinsdale, MN (US); Reed A. McPeak, Hugo, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/363,662

(22) Filed: Feb. 27, 2006

Related U.S. Application Data

(62) Division of application No. 10/373,882, filed on Feb. 12, 2003, now Pat. No. 7,073,447.

(51) Int. Cl.
*F42C 19/12* (2006.01)

(52) U.S. Cl. ..... 102/202.8; 102/202.7; 102/202; 102/472; 219/121.48; 219/121.52

(58) Field of Classification Search ..... 102/202, 102/202.11, 202.12, 202.14, 202.5, 202.7, 102/202.8, 205, 472; 89/8; 219/121.36, 219/121.48, 121.52
See application file for complete search history.

(56) References Cited

U.S. PATENT DOCUMENTS 4,495,866 A 1/1985 Brede et al.
H357 H 11/1987 Howland et al.
5,072,647 A 12/1991 Goldstein et al.
5,076,136 A 12/1991 Aivaliotis et al.
5,090,292 A 2/1992 Reip et al.
5,220,126 A 6/1993 Borgwarth et al.
5,225,624 A 7/1993 Schneider et al.
5,231,242 A 7/1993 Chryssomallis et al.
5,233,903 A 8/1993 Saphier et al.
5,283,499 A 2/1994 Adam et al.
5,287,791 A 2/1994 Chaboki et al.
5,304,739 A 4/1994 Klug et al.
5,355,767 A 10/1994 Morita
5,425,570 A 6/1995 Wilkinson
5,431,105 A 7/1995 Wilkinson
5,444,208 A 8/1995 Mortensen
5,463,928 A 11/1995 Boggavarapu et al.
5,503,058 A 4/1996 Marinos
5,503,081 A 4/1996 Lindblom et al.
5,515,765 A 5/1996 Wilkinson
5,528,973 A 6/1996 Pfenning et al.
H1598 H 10/1996 O'Reilly et al.
5,656,796 A 8/1997 Marinos et al.
5,675,115 A 10/1997 Hershkowitz (Continued)

*Primary Examiner*—James S Bergin
(74) *Attorney, Agent, or Firm*—Patterson, Thuente, Skaar & Christensen, P.A.

(57) ABSTRACT

An ETC igniter and compatible electrical connector for enabling an ETC gun to be used in a battlefield setting in close proximity with personnel and sensitive electronic equipment. This is accomplished by providing a current path to and from the igniter that is electrically isolated from all other portions of the gun. The connector and igniter are adapted to be capable of withstanding the high connection forces necessary to prevent arcing and the extreme stresses imposed during firing of the gun.

1 Claim, 4 Drawing Sheets

U.S. PATENT DOCUMENTS 5,688,416 A 11/1997 Johnson
5,767,439 A 6/1998 Lindblom et al.
5,830,377 A 11/1998 Johnson
5,880,427 A 3/1999 Johnson
5,886,290 A 3/1999 Lindblom et al.
5,898,124 A 4/1999 Krumm et al.
5,945,623 A 8/1999 Goldstein et al.
5,988,070 A 11/1999 Krumm et al.
6,119,599 A 9/2000 Johnson et al.
6,167,810 B1 1/2001 Isle et al.
6,237,494 B1 * 5/2001 Brunet et al. ..... 102/202.7
6,247,412 B1 6/2001 Vornfett
6,332,403 B1 12/2001 Weise et al.
6,408,759 B1 6/2002 Ewick et al.
6,539,874 B2 4/2003 Weise
6,578,493 B2 6/2003 Weise et al.
6,679,236 B2 1/2004 Skinner et al.
6,703,580 B2 * 3/2004 Brunet et al. ..... 219/121.52
6,717,493 B2 4/2004 Chopra et al.
6,740,841 B2 * 5/2004 Brunet et al. ..... 219/121.52
6,761,116 B2 7/2004 Daoud
6,884,113 B1 4/2005 Montena
6,910,420 B1 6/2005 Thompson et al.
7,059,249 B2 * 6/2006 Chaboki et al. ..... 102/202.8
7,073,447 B2 * 7/2006 Triviski et al. ..... 102/205

* cited by examiner

ELECTRO-THERMAL CHEMICAL IGNITER AND CONNECTOR

RELATED APPLICATION

This application is a division of application Ser. No. 10/373,882 filed Feb. 12, 2003 now U.S. Pat. No. 7,073,447.

FIELD OF THE INVENTION

This invention relates to electro-thermal chemical guns, and more particularly, to high-energy igniters and power connectors for electro-thermal chemical cartridges.

BACKGROUND OF THE INVENTION

Electro-thermal chemical (ETC) gun systems have been developed in response to a need for improved medium and large caliber gun performance. Typically, an ETC ammunition round has an igniter assembly. The igniter assembly serves to generate a high-energy plasma from electrical energy supplied to the igniter, and to inject the plasma into a mass of chemical propellant, which is then ignited by the high-temperature plasma. The very high energy and temperature of the plasma enables the use of multi-layer and higher density chemical propellants. Such propellants, although harder to ignite, enable a stronger and more lengthy useful pressure pulse to the projectile, thereby improving gun system performance. One example of such a propellant system is disclosed in U.S. Pat. No. 6,167,810, which is assigned to the owner of the present invention, and which is hereby fully incorporated herein by reference. In addition, the plasma energy itself may serve to provide an additional accelerating force to the projectile, thereby improving gun performance.

Examples of plasma igniter apparatus for ETC gun systems are disclosed in U.S. Pat. Nos. 5,231,242, 5,287,791, 5,503,081, 5,767,439, 5,444,208, 5,830,377, all assigned to the owner of the present invention, and each of which is hereby fully incorporated by reference herein. In addition, further examples of an ETC plasma igniter are disclosed in co-pending U.S. patent application Ser. No. 09/767,542, assigned to the owner of the present invention, and fully incorporated herein by reference.

Generally, it is desirable that an ETC igniter apparatus supply about 100 kJ or more of plasma energy to the mass of chemical propellant in an ETC cartridge. As a consequence, it is necessary to supply a slightly greater amount of electrical energy to the igniter. Moreover, for effective plasma formation, the electrical energy must be supplied over a time period measured in milliseconds. As a result, very high electrical currents at very high voltages are necessary to transfer the energy in the requisite amount of time. Currents over 50 kA or more are often necessary.

Transmission of electrical power at very high current levels presents unique challenges in the design of conductors and connection equipment. Excessive resistance in the current path will cause very rapid and destructive heating effects. In addition, strong magnetic fields may be created which can cause catastrophic failure of conductors and connectors. Moreover, connection interfaces between components in the conductive path may be prone to arcing if contaminated or if insufficient force holds the components together. As a result, it is necessary to provide a strong biasing force to press together components in the current path. This biasing force may reach levels over 1000 pounds of force, imposing high stress loads on components.

Transmission of electrical power at high currents to a plasma igniter in an ETC gun application presents even greater challenges due to the extreme physical loading characteristics of the application. The breech assembly of a typical 120 mm ETC gun may be subjected to a load of more than 2,000,000 pounds upon firing, resulting in instantaneous stress loads of more than 100,000 p.s.i. in certain components. In addition, the gun and breech assembly must be designed to permit recoil. Thus, power cables must be sufficiently flexible to enable recoil, which may exceed two feet in some cases.

Specialized coaxial cables and connectors have been developed in response to the above challenges. For example, a high energy flexible coaxial cable and connector suitable for use in ETC gun applications are disclosed in U.S. Pat. No. 5,656,796, assigned to the owner of the present invention, and fully incorporated herein by reference. In addition, embodiments of another high energy power connector usable in ETC gun applications are disclosed in U.S. Pat. No. 5,220,126, assigned to the owner of the present invention, also fully incorporated herein by reference.

Past solutions, although generally successful in conveying power to an ETC gun plasma igniter while overcoming some of the electrical and physical problems described above, have not been fully suitable for practical use in a battlefield setting for a variety of reasons. The current return path in prior solutions typically leads through portions of the gun that may be exposed to human contact. Due to the high voltages and current present in the return path, such exposed portions can present an extreme life safety hazard to personnel operating the gun, particularly where the gun may be located in a confined space such as a tank turret. Moreover, sensitive electronic devices, which may be used for communication, fire control, or other purposes, are subject to damage from stray currents or strong magnetic fields generated by the current.

In addition, the power connection in some prior art devices relies on permanent deformation of the connection components or on cumbersome and complicated connectors in order to achieve sufficient connection force to avoid arcing. These methods and devices are generally unsuitable for a battlefield device which must be capable of repeated, reliable, and rapid connection and disconnection so that a relatively high rate of fire may be achieved.

What is still needed is a high-energy power connection apparatus, especially adapted for use in a battlefield setting, that is suitable for connecting an ETC igniter apparatus in an ETC gun with a high-energy power source.

SUMMARY OF THE INVENTION

The ETC igniter and compatible electrical connector hereof, enable an ETC gun to be used in a battlefield setting in close proximity with personnel and sensitive electronic equipment. This is accomplished by providing a current path to and from the igniter that is electrically isolated from all other portions of the gun. The connector and igniter are adapted to be capable of withstanding the high connection forces necessary to prevent arcing and the extreme stresses imposed during firing of the gun.

A combination high-energy electrical connector and electro-thermal chemical igniter includes an igniter having a base portion adapted to be operably coupled with an ammunition cartridge case. An electrical connector located in the igniter base portion includes a supply conductor, a return conductor, and a plurality of insulators arranged so as to electrically isolate the supply and return conductors from the base portion. The connector includes a body portion adapted to be operably coupled with a gun breech, a supply conductor having a distal portion adapted to engage and electrically connect with the supply conductor of the igniter, and a return conductor having a distal portion adapted to engage and electrically connect with the return conductor of the igniter. Insulators are arranged so as to electrically isolate the supply and return conductors from the body portion. The connector and electrical connector portion of the igniter may be coaxial. In such a coaxial arrangement, the electrical connector portion of the igniter may have a center supply conductor and an annular outer return conductor surrounding the center supply conductor. The connector may have a center supply conductor having a distal portion adapted to engage and electrically connect with the center supply conductor of the igniter, and an annular outer return conductor surrounding the center supply conductor. The connector further includes a distal portion adapted to engage and electrically connect with the outer supply conductor of the igniter. The supply conductor of the connector may be longitudinally slidable, with a pre-load spring arranged so as to resist proximal sliding of the supply conductor when the igniter is connected with the connector.

An electro-thermal chemical gun system according to the invention may include an ammunition round having an electro-thermal chemical igniter, a gun adapted to receive and fire the ammunition round, a high-energy power source, a cable connected to the high-energy power source, and a connector for connecting the cable to the igniter. The igniter, connector, and cable are adapted to provide a current supply path and a current return path, each electrically isolated from the gun.

A method of connecting a power cable from a high energy power source with an igniter in an electro-thermal chemical gun is also disclosed. The method may include the steps of:

(a) providing the igniter with an electrical connector portion including a pair of conductors, one of the conductors connected with an anode of the igniter, the other conductor connected with a cathode of the igniter, each of the conductors being insulated so as to be electrically isolated from all other portions of the igniter;

(b) forming an electrical connector having a pair of conductors and a body portion, the body portion operably coupleable to the gun, each of the pair of conductors adapted to engage and connect with a separate one of the pair of conductors of the igniter when the electrical connector is engaged with the igniter, each of the pair of conductors being insulated so as to be electrically isolated from all other portions of the electrical connector and the gun;

(c) connecting each of the pair of conductors of the electrical connector with a separate conductor of the power cable;

(d) connecting the electrical connector with the electrical connector portion of the igniter; and (e) forcing the electrical connector and the igniter together with a first biasing force of sufficient magnitude to prevent arcing between the conductors of the igniter and the conductors of the electrical connector.

DETAILED DESCRIPTION OF THE PREFERRED EMBODIMENTS

Figure 1:
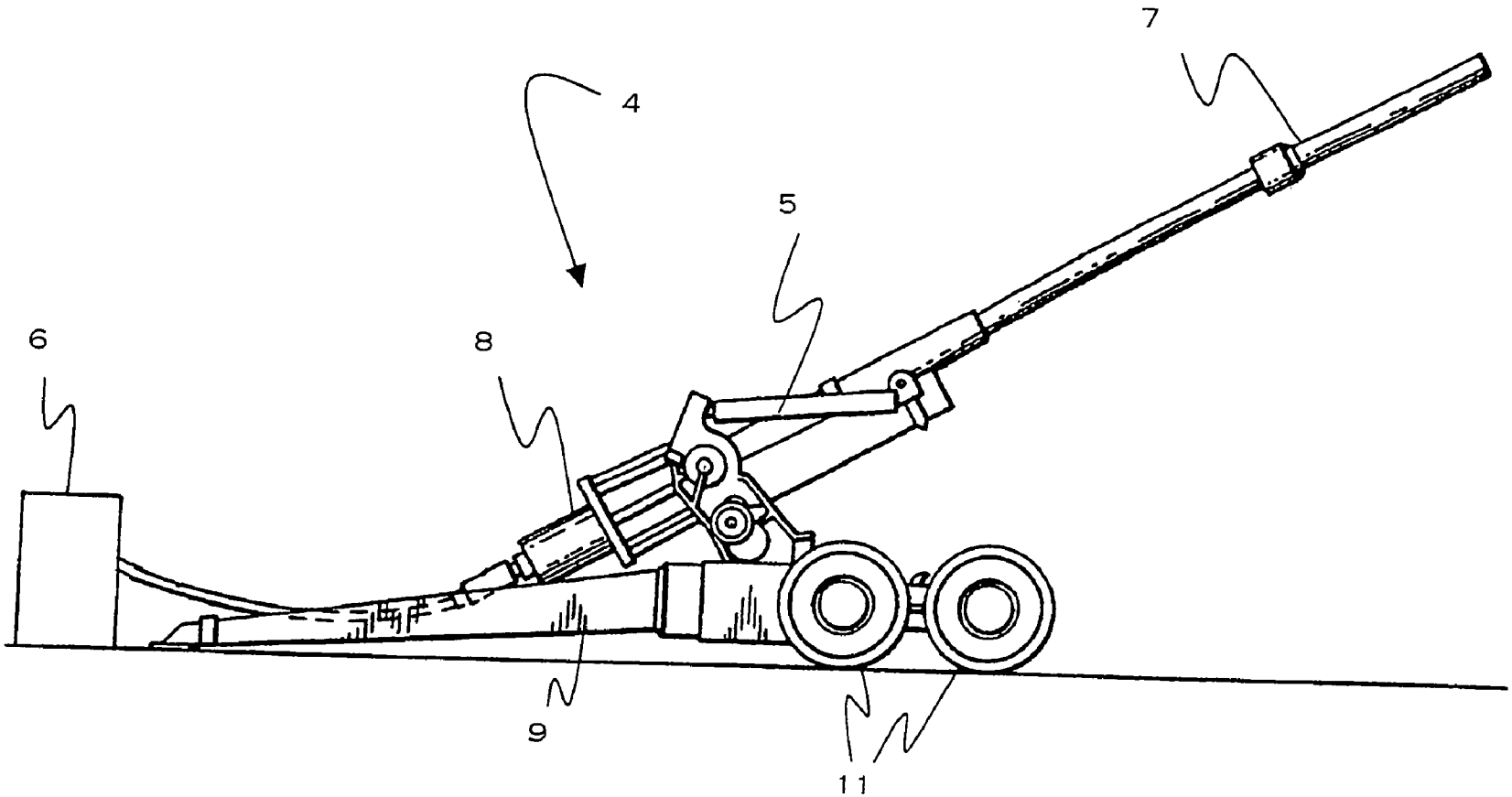
FIG. 1 is a side elevation view of an ETC gun system.

An electro-thermal chemical gun system 4 is depicted in FIG. 1. Gun system 4 generally includes gun 5 and high-energy power source 6. Gun 5 generally includes barrel 7 with breech portion 8, chassis portion 9, and power cable 10. Chassis portion 9 may have wheels 11 for mobility.

Figure 2:
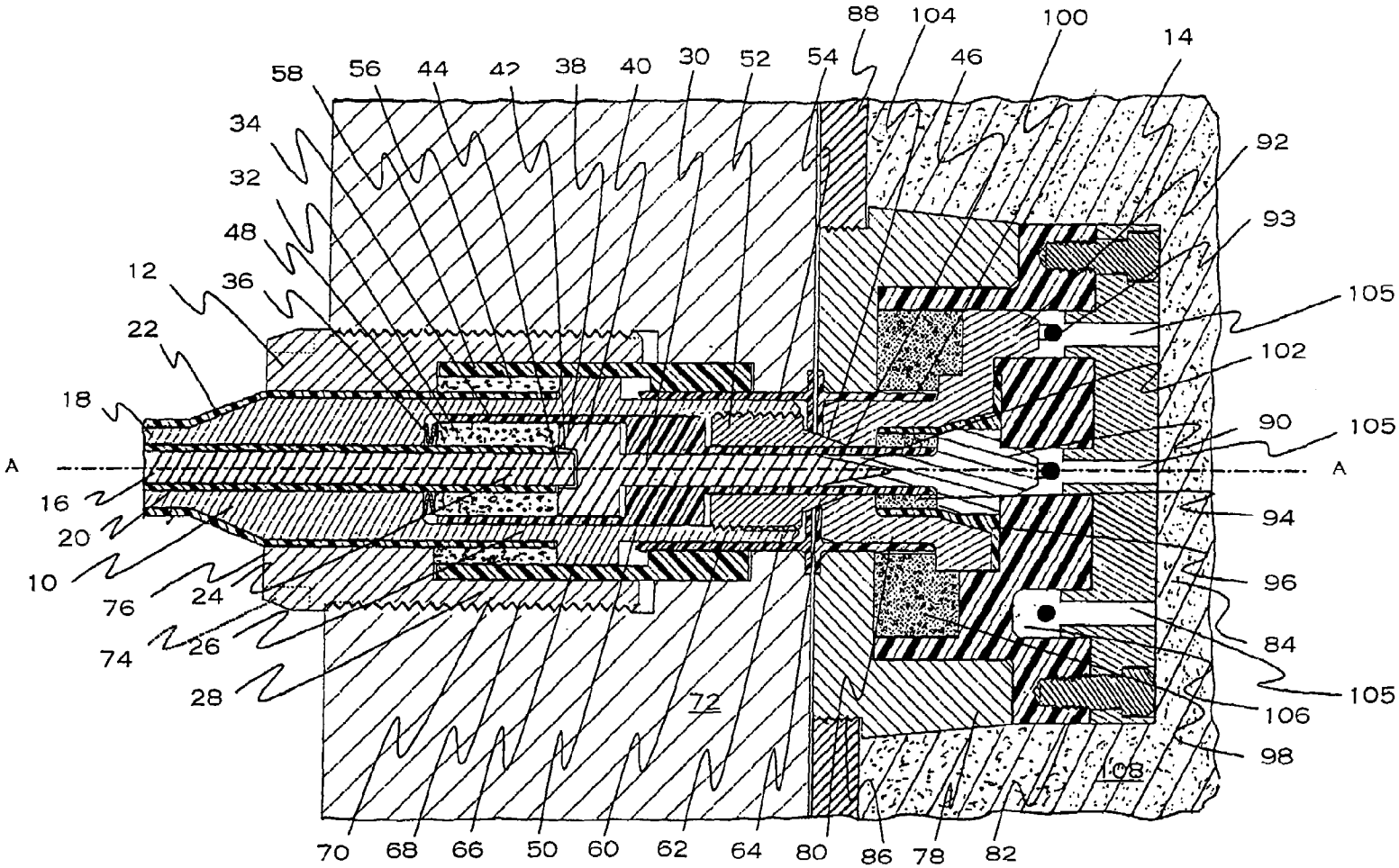
FIG. 2 is a cross-sectional view of an electrical connector and ETC igniter in a cartridge case.

A power connector and electro-thermal chemical (ETC) igniter assembly 10*a* according to the present invention is depicted in FIG. 2. The assembly 10*a* generally includes coaxial power cable 10, power connector 12, and basepad igniter 14.

Coaxial cable 10 generally includes a center conductor 16, and an outer conductor 18, separated by insulation layer 20, and covered by insulation jacket 22. One example of a suitable coaxial cable assembly is also disclosed in U.S. Pat. No. 5,656,796, previously incorporated herein by reference.

Power connector 12, generally includes center conductor assembly 24, outer conductor assembly 26, and outer sleeve 28. Connector 12 is generally cylindrical and presents a longitudinal axis, annotated A-A in the drawings.

Center conductor assembly 24 of power connector 12 generally includes center pin 30, insulating sleeves 32, 34, and preload spring 36. Proximal end 38 of center pin 30 has an enlarged portion 40 with a socket 42 for receiving the distal end 44 of center conductor 16 of coaxial cable 10. Distal end 46 of center pin 30 may be conically shaped, as depicted in the drawings, for improved electrical conductivity. Insulating sleeve 32, which may be formed from a material having a high compressive strength such as ceramic, is slidably disposed around insulation layer 20. Preload spring 36 bears on the proximal end 48 of insulating sleeve 32 and supplies a biasing force which presses insulating sleeve 32 against the proximal end 38 of center pin 30, thereby biasing center pin 30 distally. Pre-load spring 36 is depicted as a Belleville washer, but may also be any other suitable resilient member. Insulating sleeve 34 is slidably disposed over center pin 30 so as to enable slight longitudinal movement of center pin 30. Insulating sleeve 30 may be made from any suitable relatively high strength material such as polycarbonate plastic.

Outer conductor assembly 26 of power connector 12 generally includes conductor portion 50, annular sleeve 52, insulator 54, and insulating sleeves 56, 58. Conductor portion 50 is generally tubular and may have an interior threaded portion 60 engaged with corresponding threads 62 of annular sleeve 52. Annular sleeve 52 has a frusto-conical wedge portion 64, which projects distally through insulator 54. Insulating sleeve 56, which again may be formed from a high compressive strength material such as ceramic, is disposed around insulation jacket 22 and is longitudinally sandwiched between shoulder portion 66 of conductor portion 50 and outer sleeve 28. Insulating sleeve 58 electrically separates shoulder portion 66 from outer sleeve 28.

Outer sleeve 28, which may be formed from high strength material such as high-carbon nickel-chromium-molybdenum alloy steel, may have an exterior threaded portion 68 so that connector 10 may be threaded into a bore 70 formed in a gun breech 72. Flats 74 may be provided at the proximal end 76 of outer sleeve 28 to facilitate manual threading of the connector. Alternatively, connector 10 may be forced into bore 70 by a hydraulic or other machine capable of supplying a force, as will be further explained hereinbelow.

Basepad igniter 14 generally includes base 78, power connector portion 80, plasma containment portion 82, and vent cover 84. Base 78 has a threaded portion 86 so that the igniter 14 may be threaded into a cartridge case 88 of an ammunition round from the inside.

Power connector portion 80 generally includes anode 90, cathode 92, wire 93, and insulating sleeves 94, 96, 98, 100. Anode 90 has a conical socket 102 for receiving the conical shaped distal end 46 of center pin 30. Anode 90 is electrically connected with cathode 92 by wire 93, but is otherwise electrically isolated from cathode 92 by cooperating insulating sleeves 94, 96. Insulating sleeve 94 may be made from a high compressive strength insulating material such as ceramic, while insulating sleeve 96 may be made from any suitable relatively high-strength material such as polycarbonate plastic.

Cathode 92 has a frusto-conical socket portion 104 for receiving wedge portion 64 of power connector 12. Cathode 92 is electrically isolated from base 78 by insulating sleeves 98, 100. Again, insulating sleeve 98 may be made from ceramic or other similar material having a high compressive strength.

Plasma containment portion 82 fits over base 78 and has a generally spiral shaped plasma channel 106 connecting anode 90 and cathode 92. Plasma containment portion 82 is formed from a generally insulative material such as plastic. Vent cover 84 is disposed over plasma containment portion 82, and has vent apertures 105 leading from plasma channel 106 to the interior of the cartridge case, which contains chemical propellant 108.

The operation of the invention may now be understood with reference to FIG. 1. Outer sleeve 28 is threaded into bore 70 of gun breech 72, causing the conical shaped distal end 46 of center pin 30 to engage and wedge into conical socket 102 of anode 90. As outer sleeve 28 is threaded further, outer conductor assembly 26 continues to advance with it, wedging frusto-conical wedge portion 64 into socket portion 104 of cathode 92. Center pin 30, being already in contact with conical socket 102, is stationary, but is wedged with steadily increasing pressure into conical socket 102 through the compression of pre-load spring 36. Outer sleeve 28 is advanced until a desired contact force is reached at both the connections between center pin 30 and socket 102 and between wedge portion 64 and socket portion 104. These compressive forces in the current path inhibit arcing, which can result in rapid heating and destruction of the components. The compressive force may preferably be in the range of 800 to 1400 pounds. The high compressive strength insulators 32, 56, 94 and 98 transmit the compressive force between the metallic components while also providing the desired electrical isolation.

Once power connector 12 is fully engaged with basepad igniter 14 as described above, a power pulse may be applied to center conductor 16 of coaxial cable 10. The power is conducted through center pin 30 to anode 90. Wire 93 vaporizes, forming a plasma arc in plasma channel 106 as current flows to cathode 92, and plasma is vented into the chemical propellant 108 through vent apertures 105. The current returns through cathode 92, outer conductor assembly 28 and outer conductor 18.

The current return path is electrically isolated from the cartridge case 88 and gun breech 72 by insulators including plasma containment portion 82, insulating sleeves 98 and 100, insulator 54, insulating sleeves 56 and 58, and insulation jacket 22. Thus, personnel and sensitive electronic devices may be located proximate the gun during firing without deleterious effects from high voltage and current.

The high strength outer sleeve 28 serves as a containment structure for power connector 12, preventing destruction of the connector from the strong magnetic forces caused by the proximity of the supply and return current paths. The high compressive strength insulators used at critical locations in the connector and igniter serve to transmit the necessary compressive forces to prevent arcing while also resisting the extreme recoil forces resulting from firing the gun.

Figure 3:
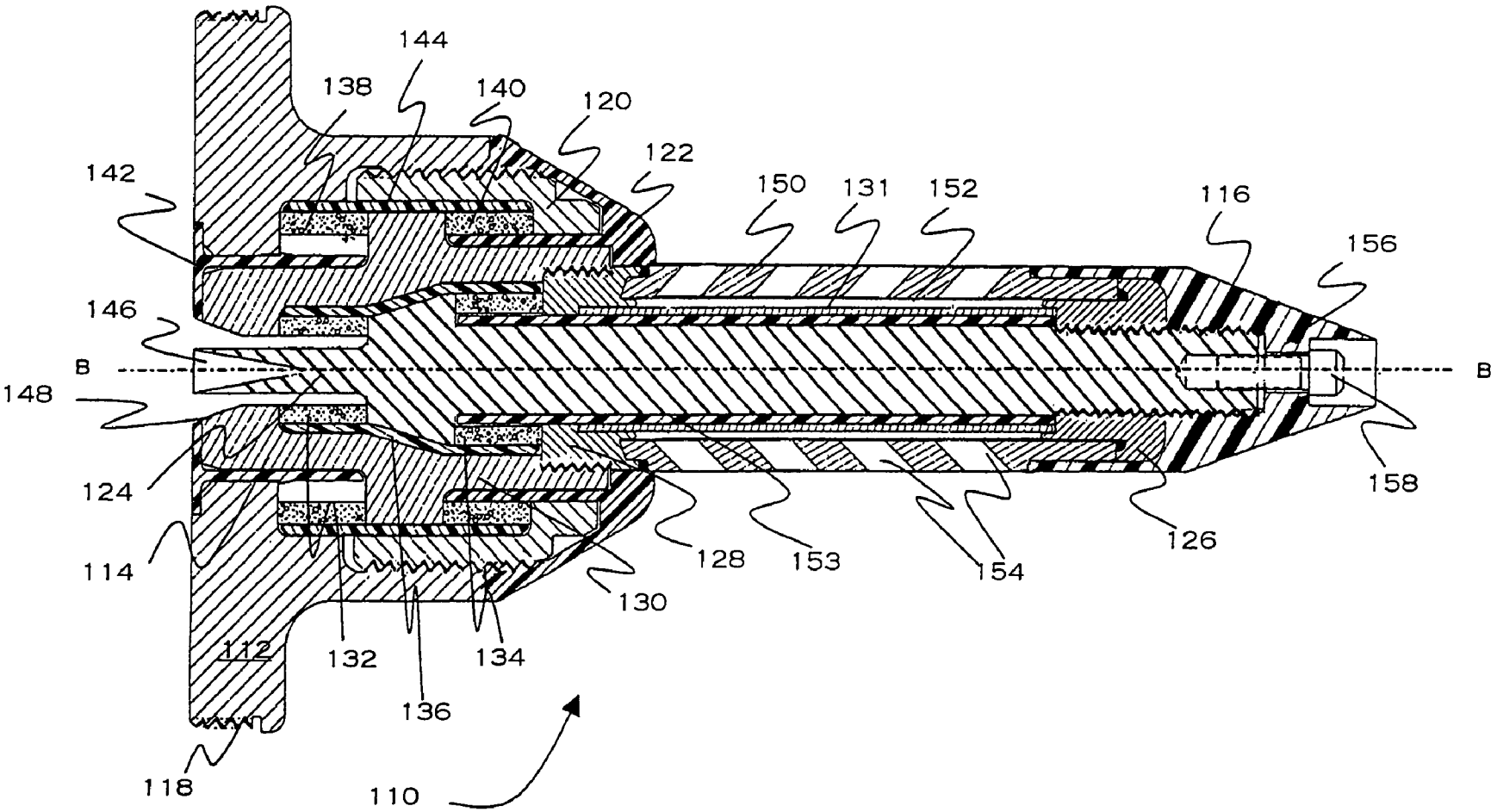
FIG. 3 is a cross-sectional view of an alternative embodiment of an igniter.

An alternative embodiment of an ETC igniter, known as a low-volume injector (LVI) igniter is depicted in FIG. 3. Igniter 110 generally includes base portion 112, electrical connector portion 114, and plasma rod 116. The igniter 110 presents a longitudinal axis annotated B-B in the drawings, which is generally coincident with the longitudinal axis of a cartridge case (not depicted).

Base portion 112 has a threaded portion 118 for threading into the cartridge case of an ammunition round from the inside. Base portion 112 also includes retainer ring 120 and insulating outer cone 122 for retaining electrical connector portion 114.

Electrical connector portion 114 generally includes center conductor 124, anode 126, cathode 128, and outer conductor 130. Wire 131 connects anode 126 and cathode 128. High compressive strength insulating sleeves 132, 134, as well as insulating sleeve 136, serve to isolate center conductor 124 from cathode 128 and outer conductor 130. Outer cone 122, high compressive strength insulating sleeves 138, 140, and insulating sleeves 142, 144, electrically isolate cathode 128 and outer conductor 130 from base portion 112 and portions of the gun connected with it. Again, center conductor 124 has a conical socket 146 for receiving the conical distal end 46 of electrical connector 12, while outer conductor 130 has a socket portion 148 for receiving wedge portion 64.

Plasma rod 116 generally includes tubular portion 150 enclosing a plasma generation region 151 in the form of plasma channel 152. Wire 131 is contained in plasma channel 152. Insulator 153 insulates wire 131 from center conductor 124. Vent apertures 154 are provided to vent plasma into a chemical propellant mixture as before. End cap 156 is disposed over the end of plasma rod 116 and is secured with fastener 158.

In operation, the electrical connector 12 may be engaged with igniter 110 in the same manner as previously described. Once engaged, a high energy current pulse may be supplied through center pin 30 to center conductor 124 and anode 126. Wire 131 vaporizes, forming a plasma arc in plasma channel 152 as current flows to the cathode 128, and plasma is vented into chemical propellant through vent apertures 154, igniting the propellant. Current returns through cathode 128, and outer conductor 130 to outer conductor assembly 26 of electrical connector 12 and outer conductor 18 of coaxial cable 10.

In the embodiment of FIG. 3, the return current is isolated from base portion 112 and all portions of the gun connected with it by outer cone 122, high compressive strength insulating sleeves 138, 140, and insulating sleeves 142, 144. Thus, a gun wherein the LVI ETC igniter is employed may be fired in proximity with personnel and sensitive electronic devices without negative effect. Moreover, the high compressive strength insulating sleeves 132, 134, 138, and 140, serve to effectively transmit the necessary compressive forces between metallic components necessary to prevent arcing, while also withstanding the extreme loads imposed during gun discharge.

Referring again to FIG. 2, for most uniform ignition of a chemical propellant charge 108, it is generally preferred that the plasma arc be exposed to the chemical propellant 108 over a relatively large area. In the depicted basepad igniter 14, this is achieved by forming a generally spiral plasma channel 106 with vent apertures 105 distributed along the length of channel 106. The spiral configuration and relative length of the channel 106 provide a plasma ignition source that is distributed over a relatively large area at the end of a cartridge case 88. Plasma itself is conductive, however, and as the plasma escapes into the chemical propellant 108 from the vent apertures 105 closest to anode 90 in the incipient stages of plasma formation, a lower resistance current path may be formed directly from anode 90 to cathode 92 through plasma in the chemical propellant 108. If the bulk of the current short-circuits through such a direct path, the result is a more concentrated plasma arc with a relatively less uniform ignition of the chemical propellant.

Figure 2A:
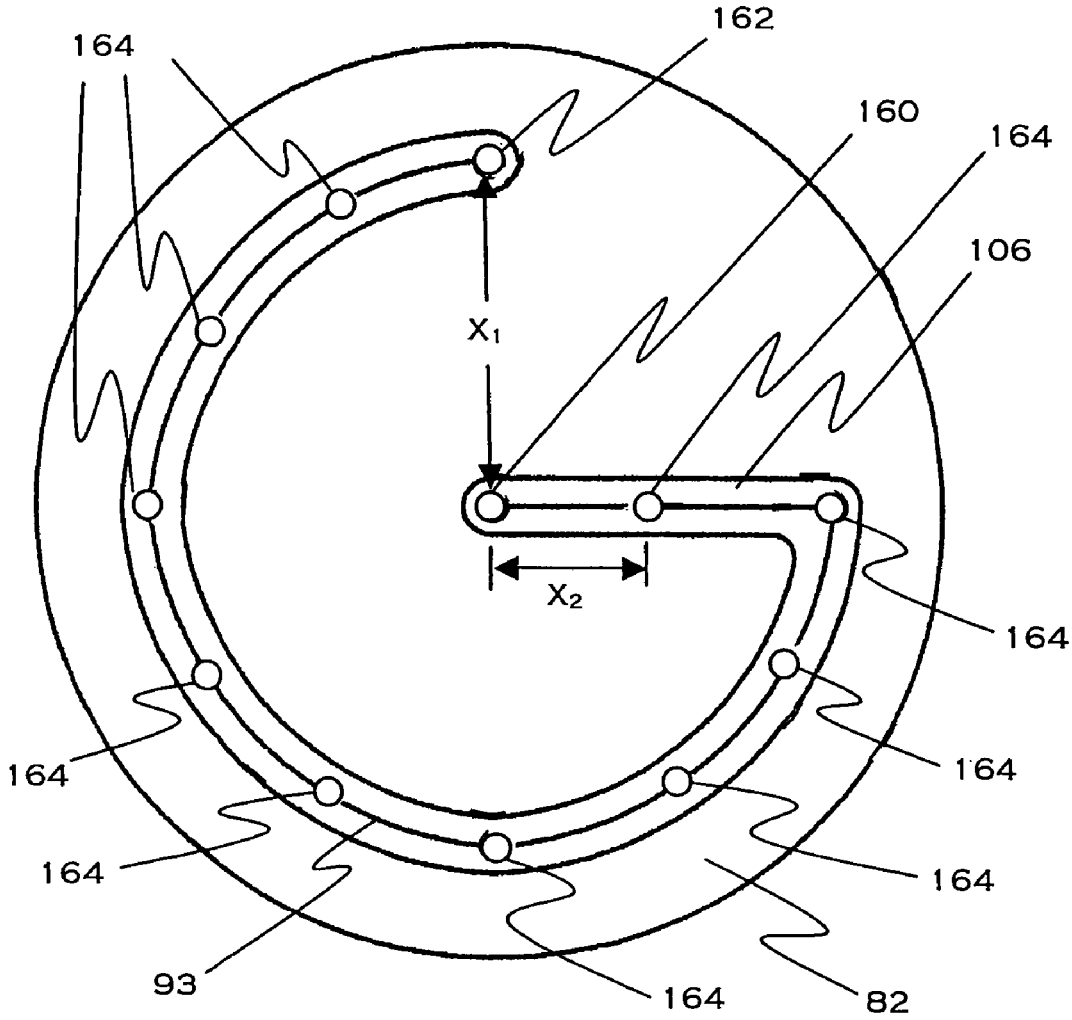
FIG. 2A is an end view of the igniter depicted in FIG. 2.

In another embodiment of basepad igniter 14, depicted in plan view in FIG. 2A, the above described short-circuiting is advantageously minimized. As depicted, vent cover 84 has been removed, exposing plasma containment portion 82. A first primary electrode 160 is connected with anode 90 and a second primary electrode 92 is connected with cathode 92. The primary electrodes 160, 162, are spaced apart a distance annotated $X_1$. Wire 93, which is disposed in plasma channel 106, electrically connects primary electrodes 160 and 162. In this embodiment, a plurality of secondary electrodes 164 are located along the length of wire 93. Each secondary electrode 164 is spaced apart a distance, annotated $X_2$, from each immediately adjacent primary electrode 160, 162, and immediately adjacent secondary electrode 164. The plasma channel 106 is configured, and the secondary electrodes 164 are positioned, so that distance $X_1$ is at least slightly greater than distance $X_2$. The distances $X_2$ between adjacent electrodes 164 along wire 93 need not be equal, so long as each is at least slightly less than distance $X_1$. In operation, when a current pulse is supplied to anode 90, and the connected primary electrode 160, the shorter path and resultantly lower resistance between primary electrode 160 and adjacent secondary electrode 164 causes the bulk of current to flow between those two electrodes, rather than directly to cathode 92 through any plasma that may be present in chemical propellant 108. In similar fashion thereafter, the relatively closer spacing of each adjacent secondary electrode 164 causes the current to flow to it, rather than directly through plasma in the chemical propellant 108. The plasma arc is thereby propagated along the entire length of plasma channel 106 as preferred.

The invention claimed is:

1. An electro-thermal chemical igniter for an ammunition round, said ammunition round including a cartridge case presenting a longitudinal axis, the igniter comprising:

a base portion adapted to be operably coupled with the cartridge case;

a plasma containment portion disposed within said base portion and adapted to be positionable transverse to the longitudinal axis of the cartridge case, said plasma containment portion defining a plasma channel having a wire disposed therein, the wire electrically connecting a pair of primary electrodes and at least one secondary electrode, the primary electrodes disposed at opposing ends of the wire, the primary electrodes separated by a distance $X_1$ and said at least one secondary electrode spaced apart from each primary electrode within the plasma channel by a distance less than $X_1$, at least a portion of said plasma channel defining an arcuate plasma channel;

an electrical connector portion in the base portion, the electrical connector portion including a supply conductor connected with a first primary electrode, a return conductor connected with a second primary electrode, and an insulator portion arranged so as to electrically isolate the supply and return conductors from the base portion, and a vent cover, said vent cover disposed over the plasma containment portion, the vent cover having a plurality of generally axially directed vent apertures formed therein, said vent apertures extending between said plasma channel and said chemical propellant.

* * * * *